US010294682B2

(12) United States Patent
Cockerell

(10) Patent No.: US 10,294,682 B2
(45) Date of Patent: May 21, 2019

(54) OUTRIGGER DEBRIS NETTING SYSTEM

(71) Applicant: Safety Guys, LLC, Dania Beach, FL (US)

(72) Inventor: Chris Cockerell, Hollywood, FL (US)

(73) Assignee: Safety Guys, LLC, Dania Beach, FL (US)

( * ) Notice: Subject to any disclaimer, the term of this patent is extended or adjusted under 35 U.S.C. 154(b) by 152 days.

(21) Appl. No.: 15/611,680

(22) Filed: Jun. 1, 2017

(65) Prior Publication Data

US 2018/0347218 A1 Dec. 6, 2018

(51) Int. Cl.
*F16M 13/00* (2006.01)
*E04G 21/32* (2006.01)

(52) U.S. Cl.
CPC ..... *E04G 21/3266* (2013.01)

(58) Field of Classification Search
CPC . E04G 21/3261; E04G 21/3223; E04G 21/24; E04G 3/30
USPC ..... 248/213.1, 499, 235; 211/180; 182/138, 182/113, 82
See application file for complete search history.

(56) References Cited

U.S. PATENT DOCUMENTS 3,949,834 A 4/1976 Nusbaum
4,074,791 A 2/1978 Inman
4,838,382 A 6/1989 Nusbaum
4,856,615 A 8/1989 Nusbaum
4,892,169 A 1/1990 Duncan
4,944,365 A 7/1990 Shalders
4,962,828 A 10/1990 Duncan
5,161,641 A 11/1992 Nusbaum
5,299,654 A 4/1994 Duncan
5,429,206 A 7/1995 Nusbaum
6,443,877 B1 * 9/2002 Hoecht ..... A63B 23/035 482/103
7,258,198 B2 8/2007 Rexroad
7,322,553 B2 1/2008 Rexroad
7,389,955 B2 6/2008 Rexroad
8,511,039 B2 * 8/2013 Dougall ..... E04G 21/3219 52/745.05
2006/0090961 A1 * 5/2006 Rexroad ..... A62B 1/22 182/138
2006/0151243 A1 7/2006 Rexroad
2006/0213723 A1 * 9/2006 Rexroad ..... E04G 21/3266 182/138
2006/0214150 A1 * 9/2006 Cockerell ..... E04G 21/3266 256/67

(Continued)

*Primary Examiner* — Steven M Marsh
(74) *Attorney, Agent, or Firm* — Berger Singerman LLP; Geoffrey Lottenberg, Esq.

(57) ABSTRACT

An outrigger netting system configured for installation on a building slab such as a balcony to protect against falling projectiles. The system includes one or more spaced apart brackets attached to a target slab, each bracket having an outrigger to support a net suspended across. The outriggers each extend outward from the edge of the slab and are each optionally angled slightly upward from the surface of the slab. A spring-dampened cable assembly is attached between the bracket and outrigger in order to dampen the impact of and resiliently catch and retain falling debris. Each bracket includes hardware to secure and level the bracket to the slab to enhance rigidity and security and prevent displacement or dislodgment of the brackets during use.

17 Claims, 7 Drawing Sheets

(56) References Cited

U.S. PATENT DOCUMENTS

2006/0237607 A1 10/2006 Rexroad
2016/0305138 A1* 10/2016 Bullock ..... E04G 21/3266

* cited by examiner

OUTRIGGER DEBRIS NETTING SYSTEM

FIELD OF THE INVENTION

This application generally relates to safety and debris netting and methods of installation for multi-floor construction and more particularly to a debris and safety outrigger netting system for multi-floor or other types of construction and related methodology.

BRIEF DESCRIPTION OF THE DRAWINGS

The drawings appended hereto are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION

Figure 1:
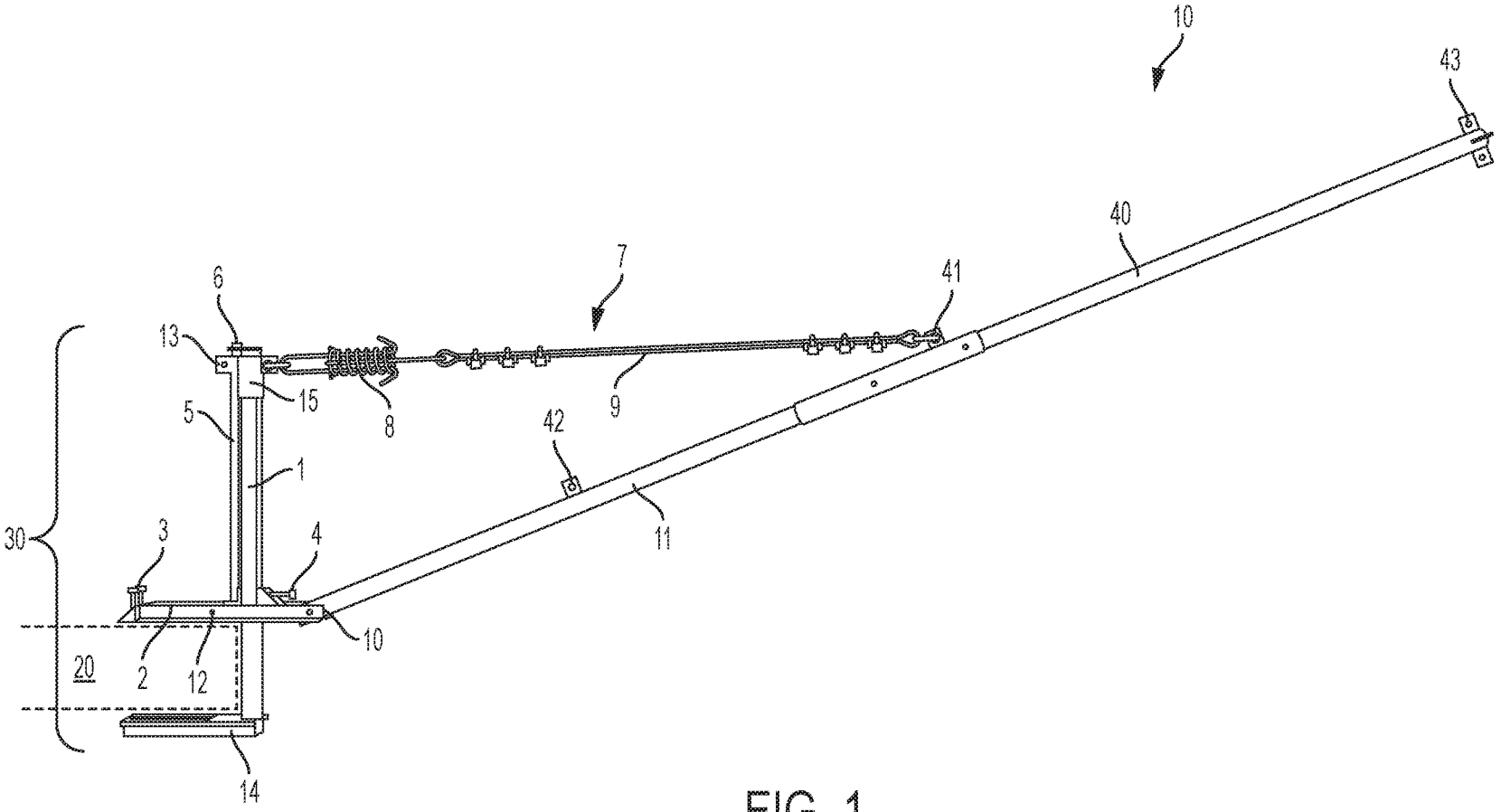
FIG. 1 is a perspective view of one embodiment of the bracket of the outrigger netting system.

For the purposes of promoting an understanding of the principles of this disclosure, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc. The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. As used herein the term "distal" generally is understood to mean that which is situated away from the center of the identified structure or from the point of attachment of said structure. The term "proximal" generally is understood to mean that which is situated nearer to the center of the body or to the point of attachment.

With reference to FIG. 1 shown is a schematic of one aspect of the outrigger netting system 10 comprising a bracket 30 and an outrigger 40. In some embodiments, the bracket 30 is configured to be attached or mounted to a fixed surface such as slab 20 comprising a balcony or other structure or feature of a building on and around which it is desired to have protection against falling debris or construction workers. The outrigger netting system 10 comprises array or a plurality of spaced apart brackets 30 disposed along or around the perimeter of the slab 20 so as to form an array of attachment points for an outrigger net to be attached to and suspended across the outriggers 40 of each such bracket 30. The outrigger 40 is attached to and extends outward from the bracket 30 and is angled upward relative to the bracket and from the surface of the slab 20. The outrigger 40 each extends outward from the edge of the target support surface, e.g. slab 20 and is optionally angled slightly upward. A net 50 is secured at one or more points along the outrigger 40 and is suspended thereacross to an adjacent outrigger 40 of an adjacent bracket 30 such that the net 50 is angled upward and away from the slab 20 in such a manner to resiliently catch and retain falling debris and/or people.

Figure 2:
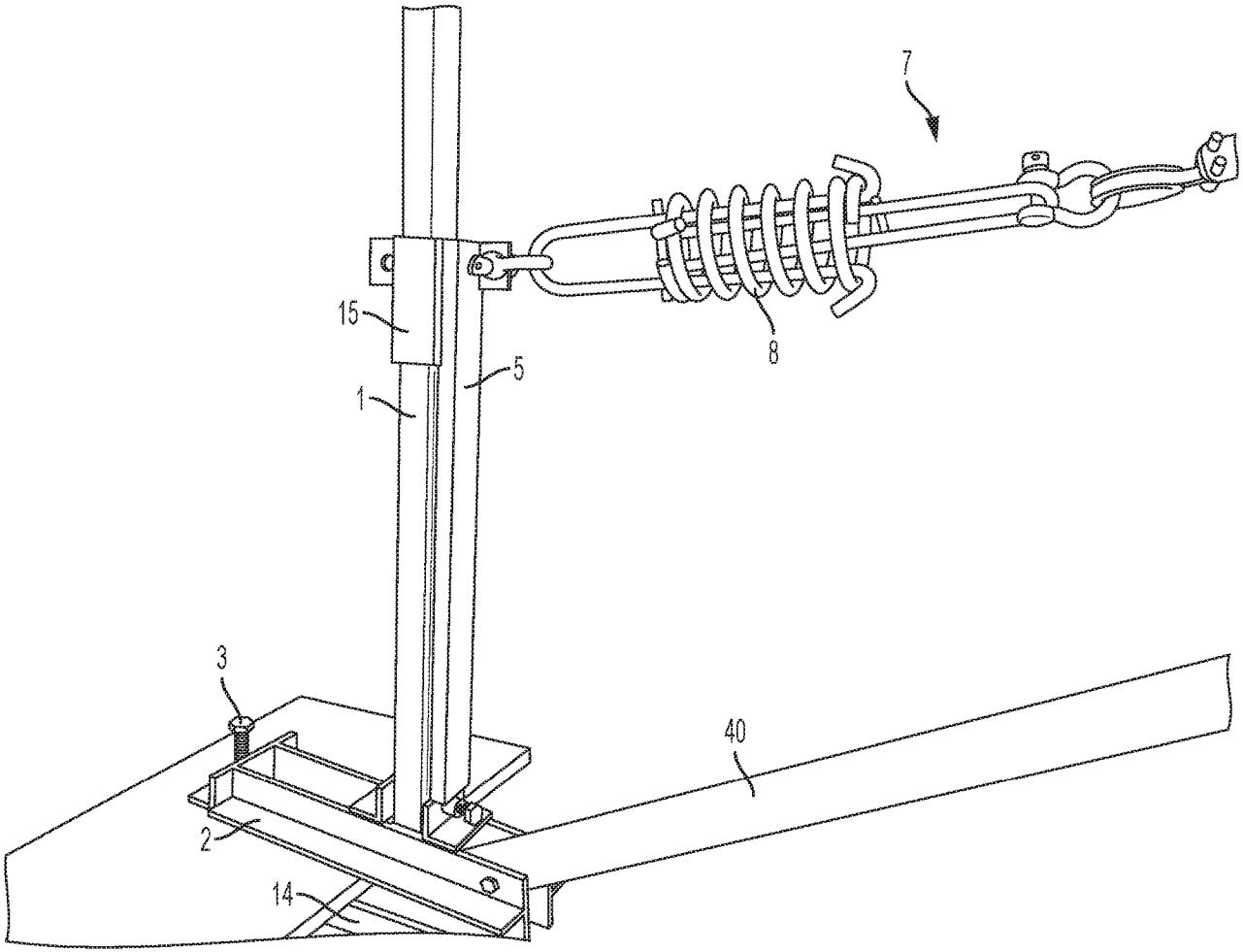
FIG. 2 is a close-up a perspective view of one embodiment of the bracket of the outrigger netting system.
Figure 3:
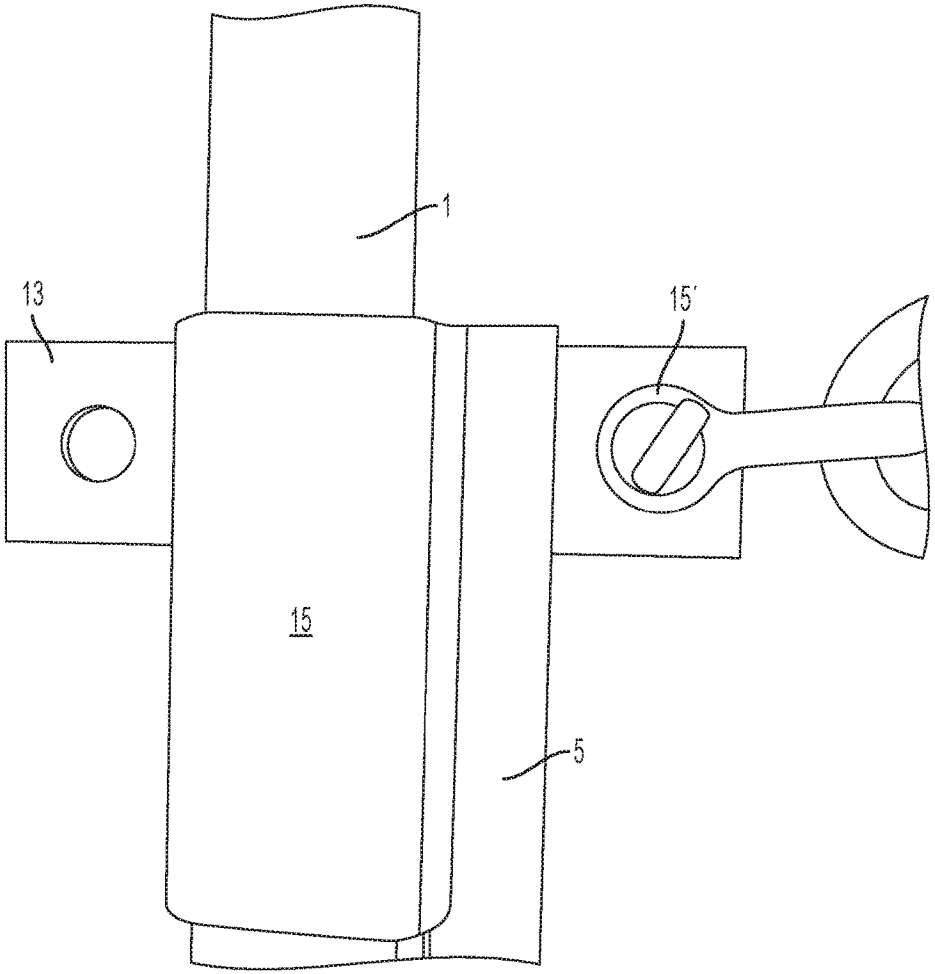
FIG. 3 is a close-up side view of the primary and secondary support members and the sleeve feature thereof.

As shown in FIGS. 1 and 2, the bracket 30 comprises a primary support member 1 disposed substantially perpendicular with respect to an upper support plate 2. The primary support member 1 is slidable and adjustable through the upper support plate 2. Accordingly, in some embodiments the upper support plate 2 includes a slot or aperture through which the main support member 1 is disposed. Attached at the proximal or lower end of the primary support member 1 and extending inward therefrom is lower support plate 14. The lower support plate 14 is oriented substantially perpendicular to the primary support member 1 and substantially parallel to the upper support plate 2. Disposed adjacent to and parallel with the primary support member 1 is a secondary support member 5. In FIG. 1, the secondary support member 5 is disposed at the inner side of the primary support member 1; in FIG. 2 the secondary support member 5 is disposed at the outer side of the primary support member 1. Either configuration is contemplated by this disclosure. The secondary support member 5 is fixably attached at its proximal end to the top surface of the upper support plate 2. Attached at the distal end of the secondary support member 5 is a sleeve 15 through which the primary support member 1 is inserted and slidingly engaged and retained. Optionally provided on the opposite of the sleeve 15 is an attachment point 13 that can be used for a tie off or additional securement of the bracket 30 to the slab 20, e.g. by an auxiliary cable or the like. These features are shown in close up in FIG. 3.

The primary support member 1 is vertically translatable, adjustable, and moveable with respect to the upper support plate 2 and slidingly retained by the sleeve 15 of the secondary support member 5 (which remains fixed) such that the gap between the upper and lower support plates 2 and 14 (with the lower support plate fixed to the lower end of the primary support member 1) can be varied to accommodate slabs and attachments points of various depths, in a clamp-like fashion. By moving and adjusting the primary support member 1 up and down, the lower support plate 14 is height adjustable with respect to the fixed upper support plate. In some embodiments, the upper and lower support plates 2 and 14 have flanged edges or other features in order to assure a secure fit against fixed surface or feature to which the bracket 30 is attached, such as the aforementioned slab 20.

Figure 4:
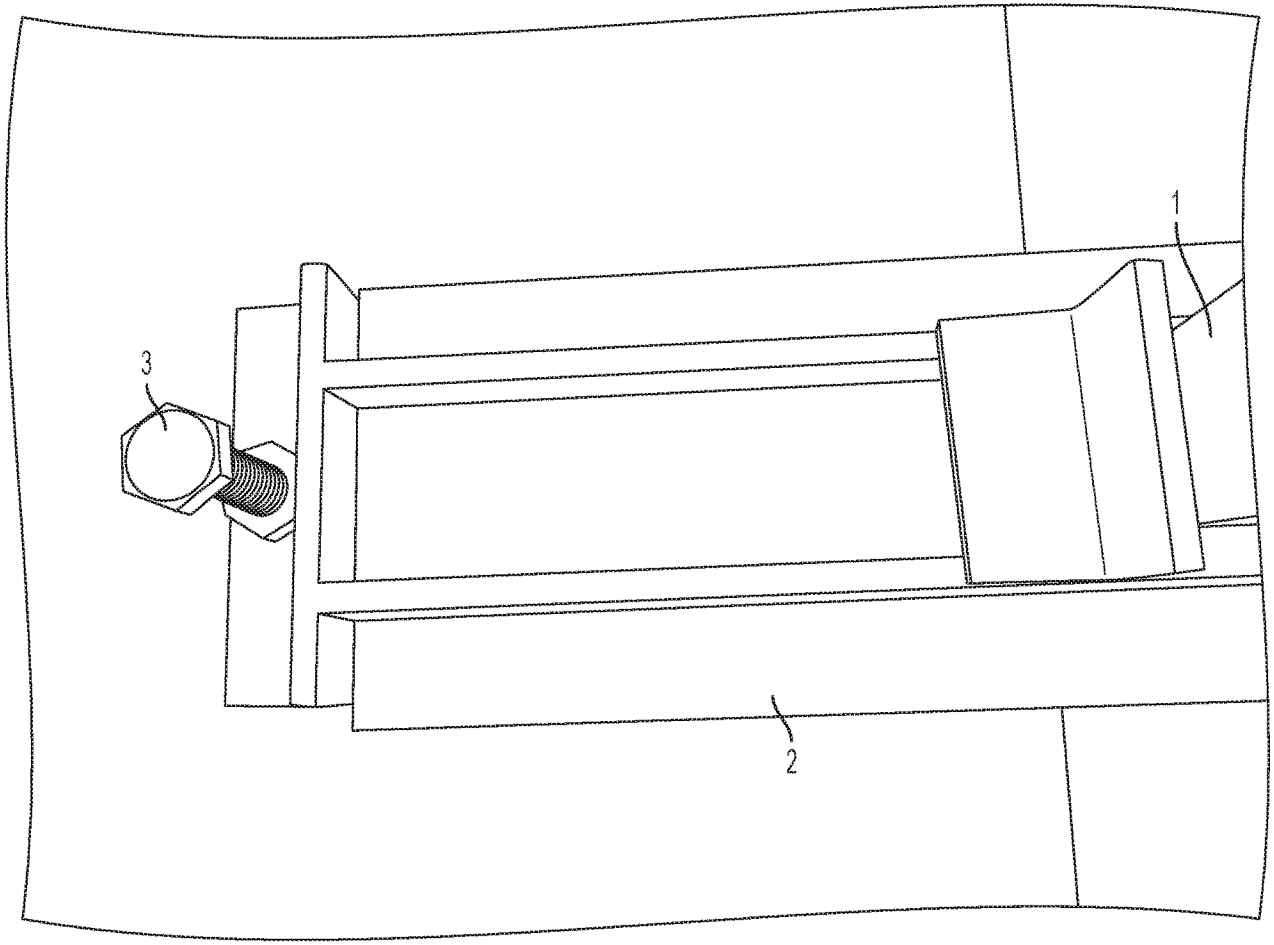
FIG. 4 is a close-up top view of the upper support plate and a locking adjustment bolt thereof.
Figure 5:
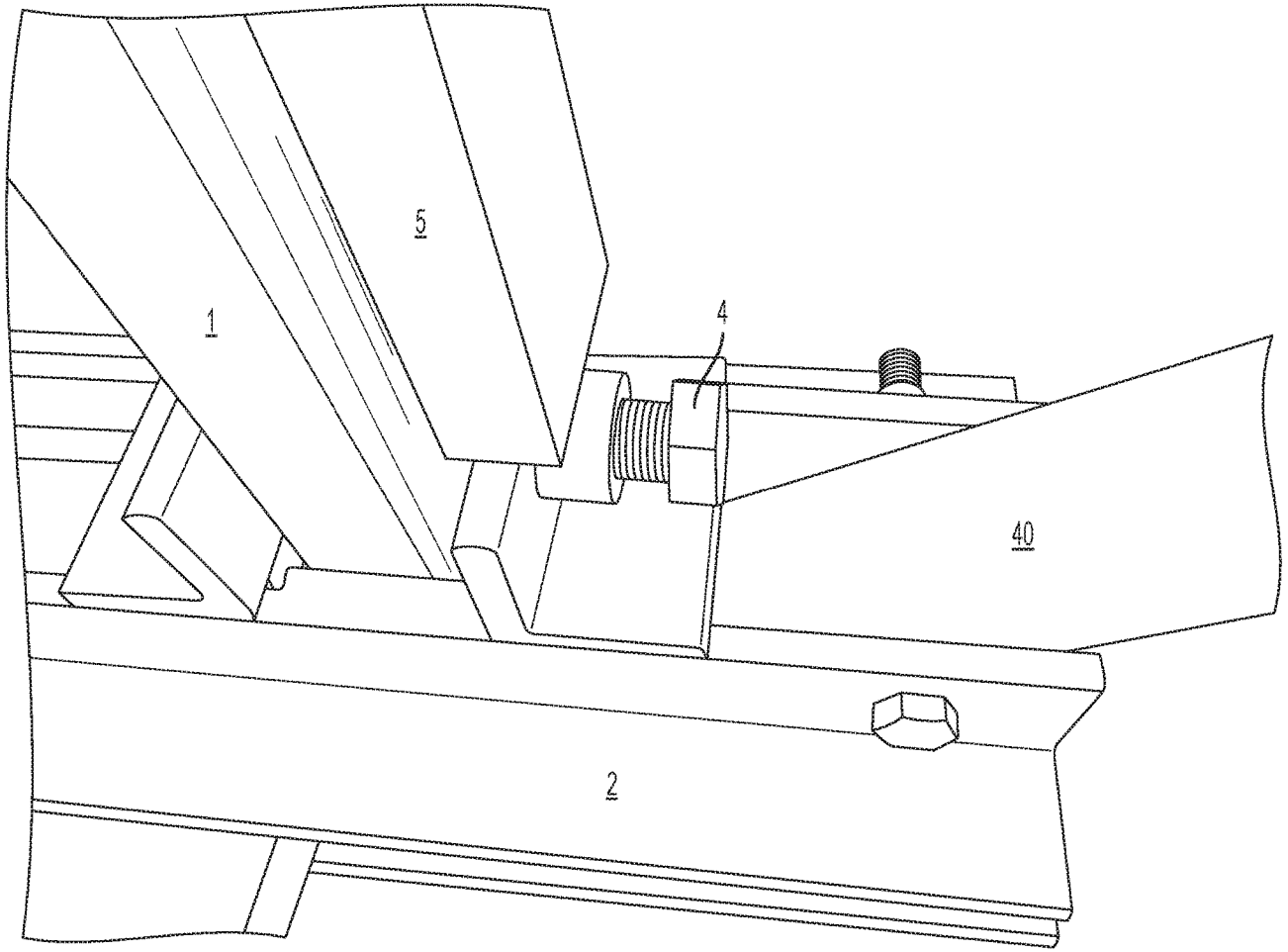
FIG. 5 is a close-up perspective view of the system and a support bolt and outrigger thereof.

The bracket 30 is modular, adjustable, and fixable to the support surface, such as slab 20. With reference to FIGS. 4 and 5, the upper support plate 2 includes a fastening system that secures the bracket 30 to the slab 20 while also assuring the upper and lower plates 2 and 14 remain as level and flush to the slab surface as possible, an important element in assuring that the bracket 30 can withstand the impact of falling debris (and other forces, impacts, oscillations, and vibrations) without becoming displaced or dislodged from the slab 20. Accordingly, the inner side of the upper support plate 2 includes a one or more locking adjustment bolts 3 disposed substantially perpendicular to the plate 2. FIG. 1 depicts two such adjustment bolts 3 whereas FIG. 4 shows an optional configuration with 2 such adjustment bolts 3. These locking adjustment bolts 3 operate as leveling devices to adjust the pitch of the support plate and as set screws to secure the plate 2 to the slab 20. Thus, in some embodiments, the adjustment bolts 3 pass through the plate 2 and come in contact with the slab 20.

As shown in FIG. 5, in some embodiments, a locking support bolt 4 is disposed substantially horizontal to the upper plate 2 (and substantially perpendicular to the primary support member 1). This support bolt 4 is disposed through an opening at the upper support plate 2 and/or the secondary support member 5 and is used to fix the primary support member 1 relative to the upper plate 2 once the components of the bracket 30 are in position. Optionally, referring back to FIG. 1, an adjustment rod 6 is disposed lengthwise through the secondary support member 5 and is threadably engaged with primary support member 1 such that by turning the adjustment rod 6 the primary support member 1 will translate up or down to be positioned and the support plates closed. This allows for the bracket 30 to readily positioned, adjusted, and secured into place using a wrench or other similar tool adapted to engage and rotate the adjustment bolt. Also shown in FIG. 5 is the hingable connection between the upper support plate 2 and the proximal end of the outrigger 40.

Referring again to FIGS. 1 and 2, an outrigger 40 is pivotably attached at its proximal end to the outer side of the upper support plate 2 and extends outwardly away therefrom and the slab 20. The outrigger 40 is optionally telescopic and adjustable to accommodate various sizes nets and is sizeable to fit a variety of installation applications including installations in close proximity to an adjacent building. The outrigger 40 is suspended by a resilient support cable assembly 7 comprising a cable 9 attached between the bracket 30 and a predetermined attachment point along the length of the outrigger 40. For example, in some embodiments, the cable 9 is attached at one end to an eyelet or attachment point 15' extending from the sleeve 15 (shown in FIG. 3) and at its other end to an eyelet or attachment point 41 along the length of the outrigger 41. The cable assembly may be attached at other locations at the bracket 30 or on the outrigger 40. To provide additional resiliency against impacts, oscillations, vibrations, and other forces, the cable assembly 7 may include a dampening spring 8 inserted in line with the cable 9. In the depicted embodiment, the dampening spring 8 is attached at one end to the sleeve 15 and at its other end to the proximal end of the cable 9. The spring 8 is configured as a tension spring in order to absorb shock and maintain tension upon the impact from falling debris or other projectiles on the system 10. In some embodiments the spring 8 is an interlocking fencing-style tension spring.

Figure 6:
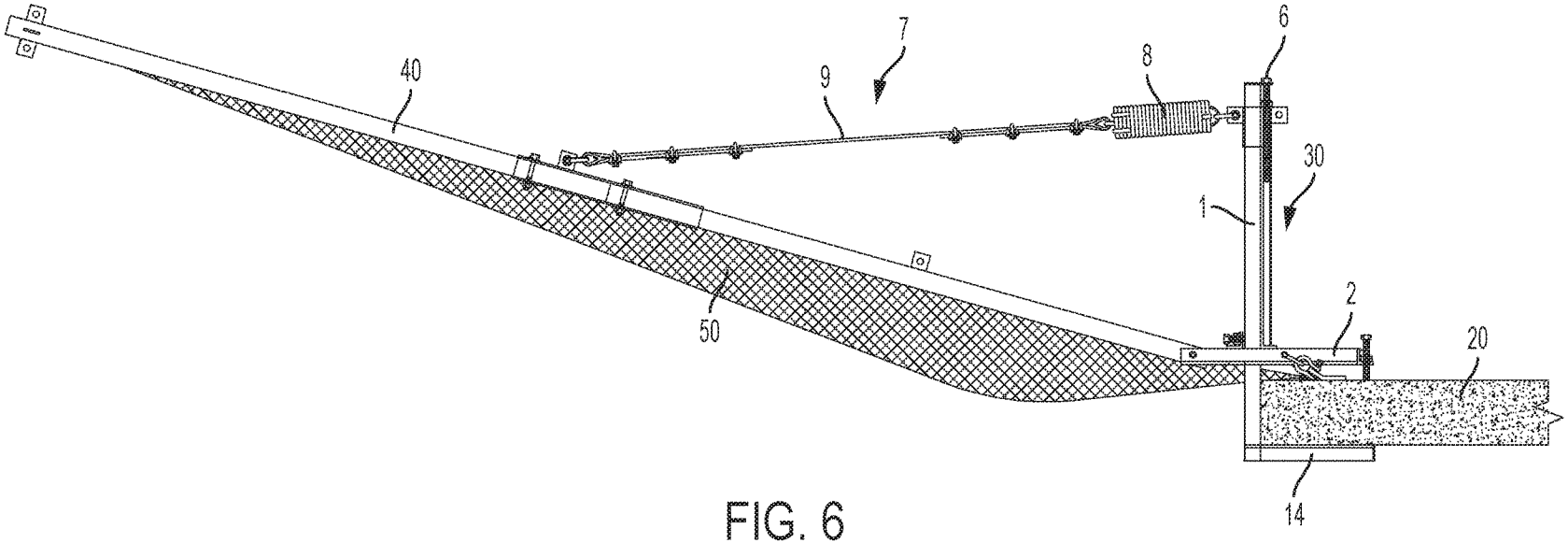
FIG. 6 is a schematic of the netting system deployed with a net.

FIG. 6 depicts the netting system 10 comprising a bracket 30 and an outrigger 40 installed with a net 50. The present invention also contemplates a method of installation of the system 10. To install each bracket 30, the upper support plate 2 is positioned and the primary support member 1 is adjusted to draw the lower support plate 14 toward the upper support plate 2, with the fixed surface, e.g. slab 20, therebetween. The adjustment bolts 3 and locking bolt 4 are then tightened in order to secure the bracket 30 firmly and level to the slab 20. The outriggers 40 of each bracket 30 are deployed and a net 50 is attached across and between the outriggers. In some embodiments, a one or more net cables 51 are traced around and attached across adjacent systems 10, for example, at the distal end of the outriggers 40 (such as at eyelets or openings 43 thereon), at intermediate points along the length of the outriggers 40 (such as at eyelets or openings 42 thereon), and at the bracket 30 (such as through an eyelet or opening 12 at the upper support plate 2). The net 50 is attached to the one or more net cables, thereby suspending the net 50 between the two adjacent outriggers 40 to catch falling debris or other projectiles.

A cable assembly 7 is configured to dampen the effects of an impact, vibration, oscillation, or other force on the net 50 and, in turn, the outrigger 40 that would naturally cause the outrigger 40 to displace downward and outward and then rebound back to its initial position. The cable assembly 7, particularly one equipped with a dampening spring 8, will dampen the effects of an impact applied to the net 50, which impact would otherwise cause a traditional outrigger bracket to displace or potentially dislodge from the slab 20. Accordingly, the present invention through the use of the spring-dampened cable assembly 7 avoids catastrophic failure of the bracket 30, particularly from the force of impact from large and heavy objects. The dampening ability is additionally advantageous against the effects of other indirect forces on the system 10, such as wind, rain, and vibrations or oscillations that may occur naturally or due to construction. It is also appreciated that the ability to fine tune the positioning and attitude of the upper and lower support places 2 and 14 by way of the bolts 3 and 4, and adjustment rod 6, and other adjustment features assures that the bracket 30 is in its most advantageous and secure position. These features also greatly improve the ease of installation and use, reducing user error and ultimately resulting in a more secure and more durable installation.

Figure 7:
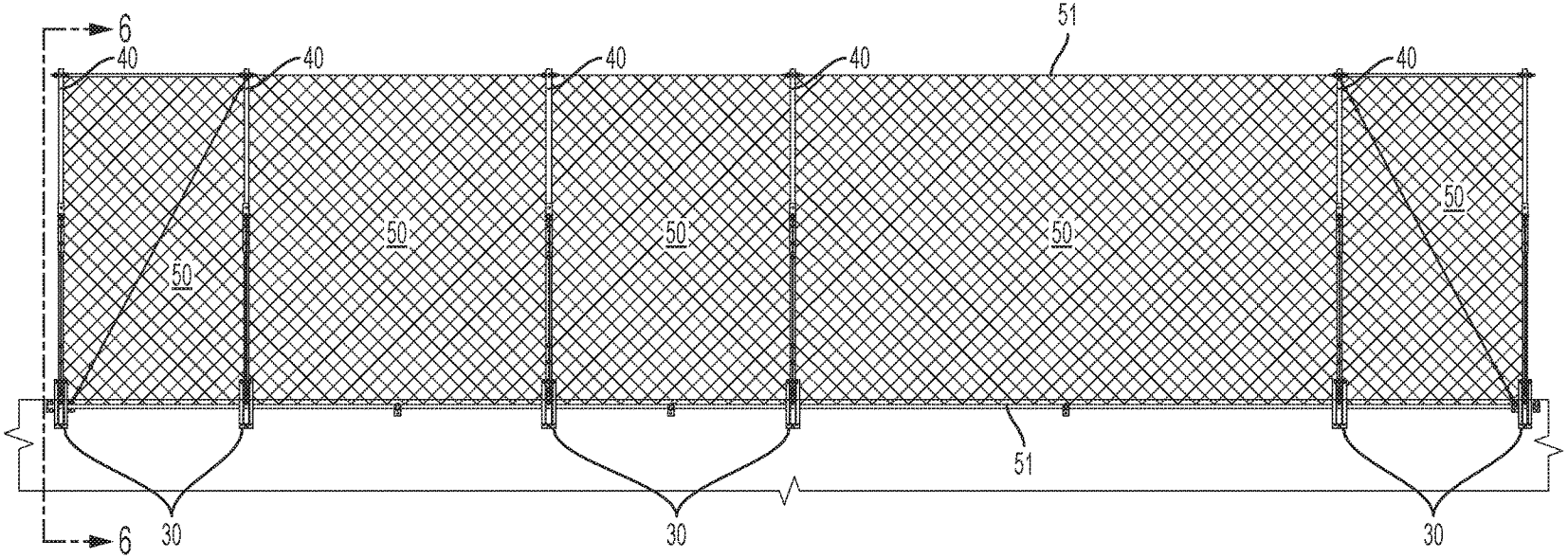
FIG. 7 is a schematic of the netting system comprising a plurality of brackets and outriggers deployed with nets.

The system 10 is designed to be installed in sets of at least two brackets 30 (each with corresponding outriggers 40) although additional brackets 30 (and outriggers 40) can be employed in order to extend coverage around the perimeter of a building. Accordingly, the netting system 10 is designed to be modular in order to permit its usage in a variety of applications and with various sized, shaped, and configured building structures. The system 10 may can be employed in a variety of building applications including high rise construction, low rise construction, bridge construction, and the like. FIG. 7 depicts a schematic of the system 10 comprising multiple brackets 30 each with an outrigger 40 deployed with nets 50.

It is appreciated and understood that the various brackets may comprise materials of varying material and cross-section. For example, wood, steel, aluminum, and combinations thereof may be employed. Cross-sections may vary as the bracket beams may be tubular, square, or L-shaped. The net 50 can vary in type, thickness and designed although it may desirable to employ a net 50 with a fine mesh backing or fine mesh array in order to retain and prevent the dispersion of debris, especially that occurring during stucco, tile, and concrete application. Larger mesh arrays may be more useful for catching and retaining large debris and projectiles. The means of attaching the net 50 and net cables 51 to the distal ends of the brackets can vary but may include hooks, clips, eyelets, and other like fastening or securing means.

By way of non-limiting example, it is helpful to describe certain relative dimensions of system components. In some embodiments, it is desirable for the outrigger to be adjustable from 8 to 13 feet, with 13 feet being the optimal maximum length to assure maximum coverage and resiliency. The spacing of the adjacent systems 10 may also vary although in one embodiment it is desirable that the brackets are spaced apart no greater than 15 feet in order for the net 50 to remain taut and secure.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A bracket, comprising:

a primary support member and an upper support plate substantially perpendicular to said primary support member, said primary support member vertically adjustable with respect to said upper support plate;

said primary support member having at its proximal end a lower support plate substantially parallel with said upper support plate;

a secondary support member disposed adjacent and parallel to said primary support member, said second support member fixably attached to said upper support plate;

an outrigger hingably attached to said upper support plate;

a cable attached at a first end to said bracket and at a second end to said outrigger;

wherein said upper and lower support plates are configured to clamp to a target support surface; and wherein said cable dampens the impact of a force applied to said outrigger.

2. The bracket of claim 1, comprising an adjustment rod disposed in said secondary support member and threadingly engaged with said primary support member, wherein rotating said adjustment rod translates said primary support member with respect to said upper support plate.

3. The bracket of claim 1, wherein said secondary support member comprises a sleeve wherein said primary support member is inserted into and slidingly received and retained by said sleeve.

4. The bracket of claim 1, wherein said upper support plate includes one or more locking adjustment bolts configured to secure and level said upper support plate.

5. The bracket of claim 1, wherein a locking support bolt secures said primary support member to said upper support plate.

6. The bracket of claim 1, wherein said cable includes a tension spring to absorb and dampen said force applied to said outrigger.

7. The bracket of claim 1, wherein said outrigger is angled up with respect to said upper support plate.

8. A netting system, comprising:

at least two brackets each comprising a primary support member and an upper support plate substantially perpendicular to said primary support member, said primary support member vertically adjustable with respect to said upper support plate, said primary support member having at its proximal end a lower support plate substantially parallel with said upper support plate, a secondary support member disposed adjacent and parallel to said primary support member, said second support member fixably attached to said upper support plate, wherein said upper and lower support plates are configured to clamp to a target support surface;

an outrigger hingably attached to said upper support plate of each of said brackets;

a cable each attached between said outrigger and said bracket;

a net suspended across and between said outriggers of each of said brackets, said net configured to catch and retain falling projectiles; and wherein said cable of each of said brackets dampens the impact of a force applied to said net.

9. The netting system of claim 8, comprising an adjustment rod disposed in said secondary support member and threadingly engaged with said primary support member, wherein rotating said adjustment rod translates said primary support member with respect to said upper support plate.

10. The netting system of claim 8, wherein said secondary support member comprises a sleeve wherein said primary support member is inserted into and slidingly received and retained by said sleeve.

11. The netting system of claim 8, wherein said upper support plate includes one or more locking adjustment bolts configured to secure and level said upper support plate.

12. The netting system of claim 8, wherein a locking support bolt secures said primary support member to said upper support plate.

13. The netting system of claim 8, wherein said cable includes a tension spring to absorb and dampen said force applied to said net.

14. A method of installing an outrigger netting system, comprising:

attaching to a target surface at least two adjacent brackets each comprising a primary support member and an upper support plate substantially perpendicular to said primary support member, said primary support member vertically adjustable with respect to said upper support plate, said primary support member having at its proximal end a lower support plate substantially parallel with said upper support plate, a secondary support member disposed adjacent and parallel to said primary support member, said second support member fixably attached to said upper support plate, wherein said upper and lower support plates are configured to clamp to a target support surface, an outrigger hingably attached to said upper support plate of each of said brackets;

attaching a cable each between said outrigger and said bracket;

suspending a net across and between said outriggers of each of said brackets, said net configured to catch and retain falling projectiles; and wherein said cable of each of said brackets dampens the impact of a force applied to said net.

15. The method of claim 14, comprising an adjustment rod disposed in said secondary support member and threadingly engaged with said primary support member, wherein rotating said adjustment rod translates said primary support member with respect to said upper support plate.

16. The method of claim 14, wherein said secondary support member comprises a sleeve wherein said primary support member is inserted into and slidingly received and retained by said sleeve.

17. The method of claim 14, wherein said upper support plate includes one or more locking adjustment bolts configured to secure and level said upper support plate.

* * * * *